United States Patent [19]

Shah et al.

[11] Patent Number: 4,658,688

[45] Date of Patent: Apr. 21, 1987

[54] ROTARY PUNCH AND DIE HOLDERS FOR TURRET PUNCHES

[75] Inventors: Harshad M. Shah, Williamsville; Ronald C. Hill, Corfu; Arthur J. Lux, Eggerstville, all of N.Y.

[73] Assignee: Strippit/Di-Acro - Houdaille, Inc., Akron, N.Y.

[21] Appl. No.: 776,158

[22] Filed: Sep. 13, 1985

[51] Int. Cl.[4] ..... B26D 5/08

[52] U.S. Cl. ..... 83/552; 83/556

[58] Field of Search ..... 83/552, 556, 551, 550, 83/549, 559; 493/164

[56] References Cited

U.S. PATENT DOCUMENTS 2,363,208 11/1944 Sulzer ..... 83/552 X 4,103,414 8/1978 Herb et al. ..... 83/552 X 4,343,210 8/1982 Kuroyone ..... 83/552

4,412,469 11/1983 Hirata et al. ..... 83/556 X 4,532,845 8/1985 Jinnouchi ..... 83/552

*Primary Examiner*—James F. Coan

[57] ABSTRACT

A punch press having multiple punch tool rotatable turrets wherein at least one of the punch tools on each of upper and lower turrets is indexable to different angular orientations. Rotation of the indexable punch tools is accomplished by a slideably mounted motor for engagement with a timing pulley, which through a timing belt and a harmonic gear drive, acts to rotate the punch tools. A brake and position sensors are also provided. Synchronization of punch and die orientation is achieved through servos and control.

14 Claims, 7 Drawing Figures

FIG. 1
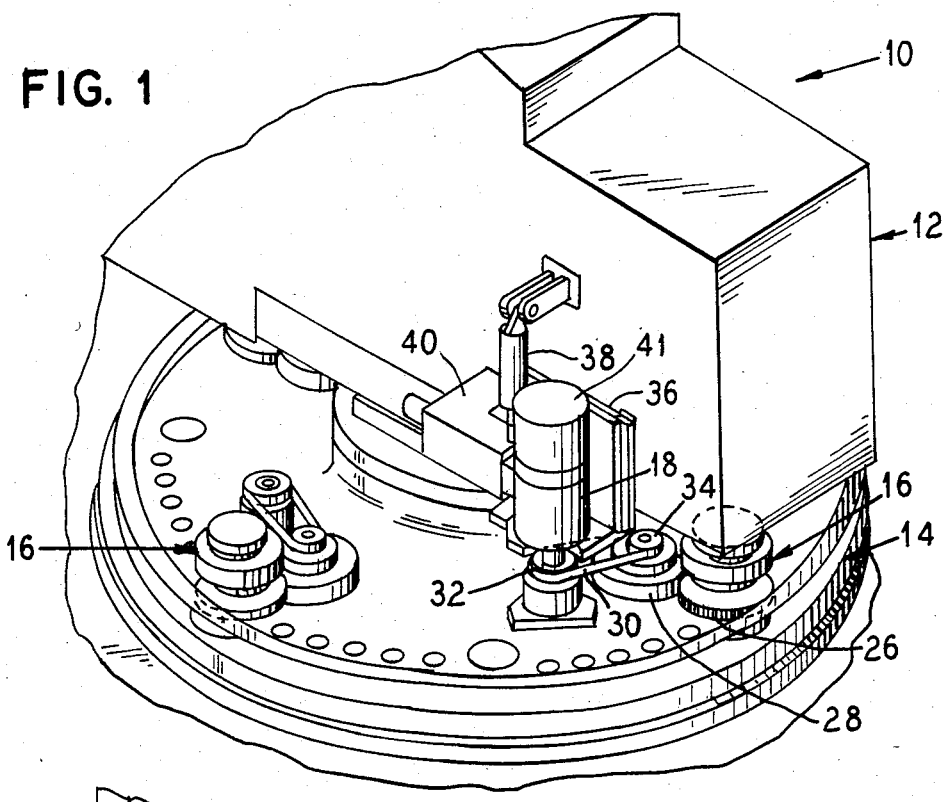
FIG. 7
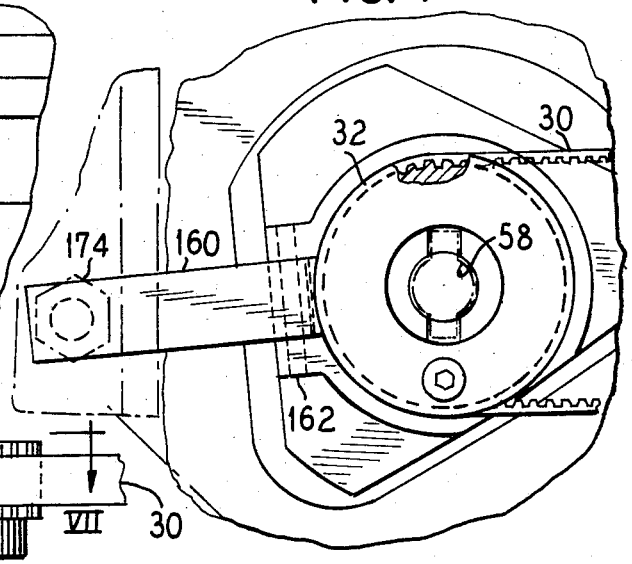
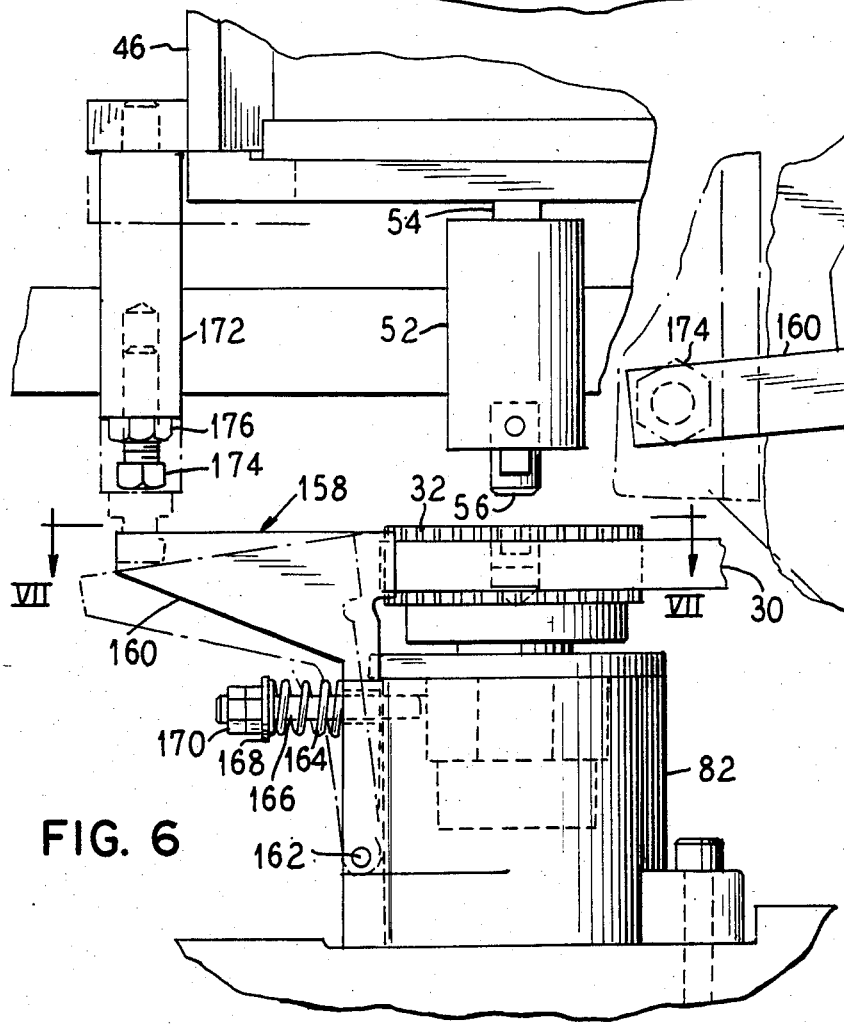
FIG. 6

ROTARY PUNCH AND DIE HOLDERS FOR TURRET PUNCHES

BACKGROUND OF THE INVENTION

1. Field of the Invention

The present invention relates generally to a turret punch press having a pair of upper and lower turrets rotatably mounted to automatically bring respective punch and dies into alignment for punching a variety of holes in sheet materials and, more particularly, to an apparatus for rotating the punch and die in the respective upper and lower turrets for punching holes in a variety of orientations.

2. Description of the Prior Art

It is known to provide rotatable punching tools in a turret punch press wherein the upper and lower punching tools are rotated synchronously for different orientations of the punch tools.

Hirata et al, U.S. Pat. No. 4,412,469 discloses a turret punch press having tool holders rotatably mounted in the turrets. Rotation of the tools is provided by servo motors mounted on brackets on the respective upper and lower portions of the punch press. An extensive series of transmitting elements for transmitting the rotational motion of the motor to the punch tool is shown, including a gear pair linking the drive shaft of the motor to a pulley, which operates through a belt to drive a pulley on a clutch and brake mechanism, which in turn operates through another pulley and a second belt to drive an idler pulley mounted on the turret, which through yet another pulley and a third belt drives a pulley encircling a holding member in which the punch tool is mounted. The clutch and brake mechanism provides a connectable linkage between the servo motors and the tools and includes a pneumatic or hydraulic motor to move a plurality of push rods in an upper portion of the clutch and brake mechanism which engage a respective plurality of bores in a lower portion of the clutch and brake mechanism. An annular friction plate restricts rotation of the lower portion when the push rods are disengaged. Magnets and sensing means are provided to detect the position of the idler pulley. It would be an improvement over the prior art to reduce the number of linkages between an indexable punch tool and a motor thereby increasing the accuracy and efficiency of the punch indexing mechanism. It would also be an improvement to provide a simpler, more reliable brake mechanism.

SUMMARY OF THE INVENTION

It is an object of the present invention to provide a highly accurate and reliable indexable punch and die on a rotatable turret punch press.

This and other objects of the present invention are embodied in an indexable punch press having a slidably mounted motor selectively engaging a coupling which through a timing belt drives a harmonic drive unit, the output of which rotates an indexable punch tool. A slidably mounted motor and harmonic drive are provided on both the upper and lower turrets to index a punch and die, respectively.

Since an improperly oriented punch tool can severely damage punch pressing equipment, it is of critical importance that an indexable punch press be extremely accurate with little room for error. The present device has this accuracy. A resolver monitors the rotation of the motor, while a toothed timing belt provides a positive drive from the motor to a harmonic drive unit. The harmonic drive provides an efficient yet accurate speed reduction for higher torque and better rotational accuracy. The output of the harmonic drive is geared directly to a rotatable bushing of a punch tool in a manner to limit backlash. Sensors are provided to establish the turret position with respect to the indexable punch stations, as well as to establish home positions for the indexable punch tools.

BRIEF DESCRIPTION OF THE DRAWINGS

FIG. 1 is a perspective view of an upper turret portion of a device according to the principles of the present invention.

FIG. 6 is an enlarged side elevational view of the device of the present invention.

FIG. 7 is a top plan view of the device as shown in FIG. 6 along lines VII—VII.

DESCRIPTION OF THE PREFERRED EMBODIMENTS

Figure 2:
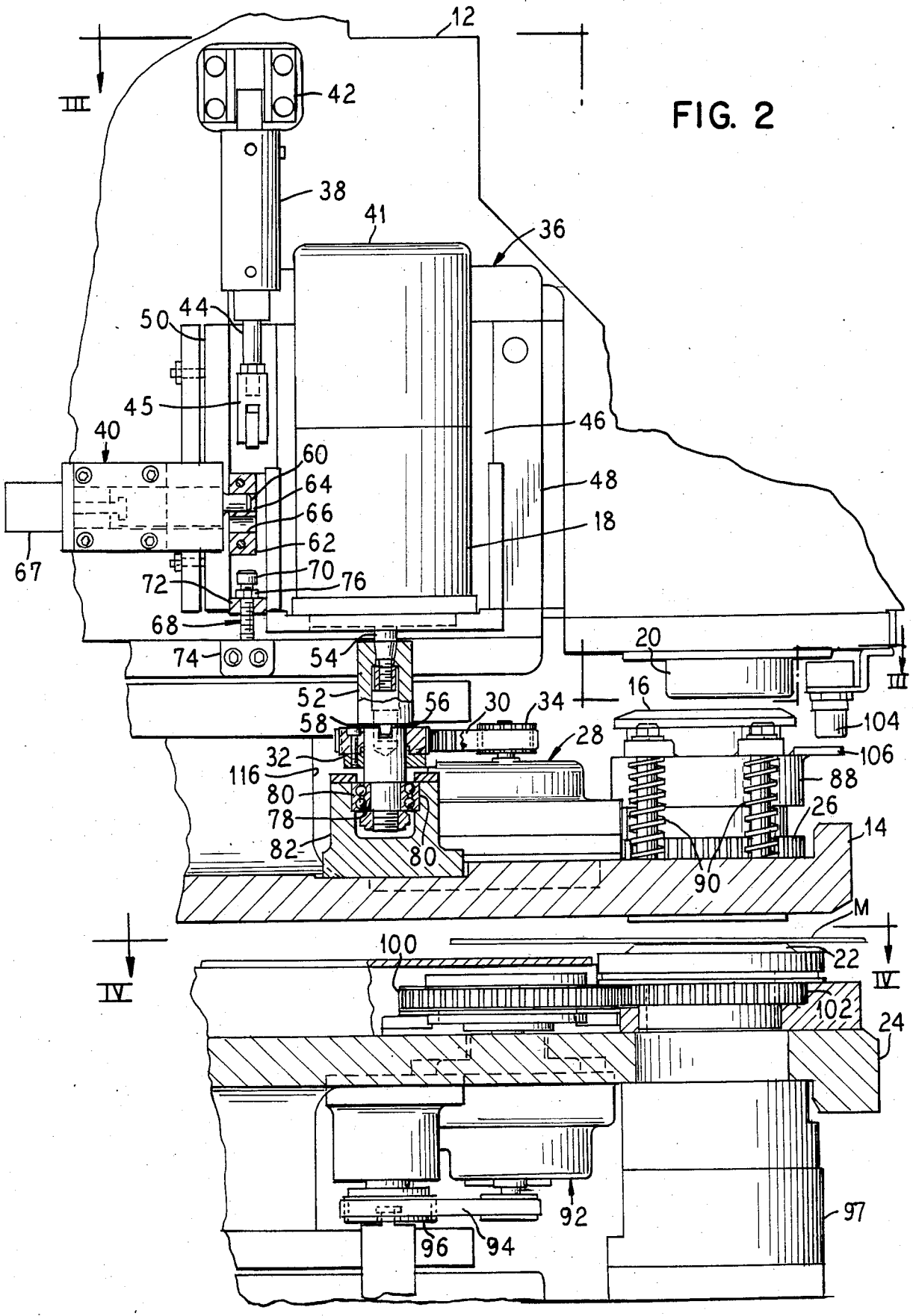
FIG. 2 is an enlarged side elevational view of the device of the present invention shown partially cut away.

Referring to FIG. 1, the device of the present invention is shown generally at 10 and includes a punch press housing 12, a rotatable turret 14, at least one indexable punching tool 16, and a punching tool drive motor 18. More specifically, a ram 20 is disposed in the punch press housing 12 for driving a punch P through a piece of sheet material M and into a die D. A plurality of punches P and dies D are mounted adjacent the perimeter of respective upper and lower turrets 14 and 24 which are rolatable to bring corresponding punches P and dies D under the ram 20. At least one indexable punch tool 16 is mounted within the rotatable upper turret 14 and a corresponding indexable die 22 is mounted in the lower turret 24 so that the indexable punch 16 and die 22 may be brought into registration under the ram 20. The indexable punch 16 is provided with a geared bushing 26 that is rotatably driven by a harmonic drive gear box 28 which in turn is driven by timing belt 30 connecting a pair of pulleys 32 and 34. The servo motor 18 is mounted on the punch press housing 12 by a vertical slide 36 and is selectively engagable to the drive pulley 32. Vertical movement of the servo motor 18 in the slide 36 is provided by an actuator 38 such as a pneumatic actuator, connected between the motor slide 36 and the punch press housing 12. The servo motor 18 may be locked into its respective upper and lower positions by a slide lock mechanism 40. A resolver 41 provides feedback from the motor 18 to a programmed controller (not shown) to monitor the angular rotation of the motor 18.

FIG. 2 shows the motor 18 slideably mounted on the housing 12. The pneumatic actuator 38 is connected at an upper end thereof to the punch press housing 12 by a bracket 42. An extendable arm 44 of the actuator 38 is connected by a clevis 45 to a slide plate 46 on which the motor 18 is mounted. The slide plate 46 slides vertically within slide rails 48 and 50 so that the motor 18 may be selectively engaged with the driver pulley 32.

Coupling between the motor 18 and the driver pulley 32 is accomplished by a coupling 52, such as a helical single flex coupling. The helical coupling is connected at one end thereof to a shaft 54 of the motor 18 and at the other end thereof to a shaft and tang arrangement 56 which engages a shaped opening 58 in the drive shaft 78, as will be described more fully in conjunction with FIGS. 6 and 7. The helical coupling 52, such as a coupling made by Helical Company, includes a helical spring (not shown) that provides relatively rigid torsional connection between the shaft 54 and the tang and shaft assembly 56, yet which gives relatively easily in a vertical direction so that misalignment of the motor 18 with the drive pulley 32 is accommodated while still transmitting the torque of the motor 18.

The slide plate 46, and the motor 18 mounted thereto, may be locked in either the coupled and uncoupled positions by a motor slide lock 40 mounted on the punch press housing 12. The motor slide lock 40 includes a shot pin 60 which is selectively insertable into a bracket 62 mounted on the slide plate 46. The bracket 62 includes first and second openings 64 and 66 through which the shot pin 60 is inserted to lock the slide plate 46 and motor 18 into the respective coupled and uncoupled positions. Movement of the shot pin 60 is controlled by an actuator 67, such as a pneumatic actuator.

An adjustable mechanical stop 68 is provided on the slide 36 in the form of a vertically disposed bolt 70 extending through an arm 72 on the slide plate 46. The bolt 70 abuts a flange 74 extending from the punch press housing 12 when the motor 18 and slide plate 46 are in the engaged position. A lock nut 76 is provided on the bolt 70 to lock the bolt 70 into position. The stop 68 prevents excessive vertical loading on the coupling 52.

When the motor 18 is in the coupled position, the helical coupling 52 provides torsional coupling between the motor shaft 54 and the drive pulley 32. The drive pulley 32 is fixed to a pulley shaft 78 which is mounted for rotation about a vertical axis by bearings 80 within a bearing housing 82. The bearing housing 82 is fastened to the turret 14.

The toothed timing belt 30 extends between the drive pulley 32 and the second pulley 34. Each of the pulleys 32 and 34 are toothed, corresponding to the teeth on the inner surface of the timing belt 30, thereby providing positive rotational drive between the pulleys 32 and 34. The second pulley 34 drives the harmonic gear drive 28, which will be described in more detail in conjunction with FIG. 5. The harmonic gear drive 28 drives a geared bushing 26 on the indexable punch 16 to provide rotation thereof.

The indexable punch 16 is provided with an annular lifter ring 88 extending therearound which is connected to lifter springs 90 extending from the turret 14 to the lifter ring 88. The ram 20 is shown above the punch 16 and during operation will drive the punch 16 through a piece of sheet material M and into the die 22. The lifter ring 88, in conjunction with the springs 90, then returns the punch 16 to its original position, lifting it from the sheet material M.

A portion of the lower turret 24 is also shown in FIG. 2. It includes an indexable die 22 which is rotated by a harmonic gear drive 92 which in turn is driven by a timing belt 94 that is driven by a vertically slidable motor (not shown) slidably mounted on the punch press housing 12 below the lower turret 24. The motor is coupled to a drive pulley 96 by a helical coupling 98. The harmonic drive 92 extends into the lower turret 24 and includes an output gear 100 engaging a geared bushing 102 encircling the die 22. An anvil portion 97 of the punch press 10 can be seen supporting the lower portion of the turret 24 to resist the downward force of the ram 20 as it pushes the punch 16 through the sheet material M and into the die 22.

A proximity switch 104 is mounted to the housing 12 and senses a target 106 on the lifter 88 to indicate that an indexable station has retracted from the material M and is safe to move the material M. Once the turret is positioned under the ram 20, a home position of the indexable punch 16 is established by a second proximity switch (not shown) mounted on the housing 12. A vane (not shown) extends from the punch bushing 26 to activate the proximity switch when the bushing 26 and the punch 16 are rotated to home position. There are other sensors (not shown) to indicate that an indexable station is positioned below the ram 20,. These sensors are of proximity type and mounted on the frame 12. A target on the bushing of the die 22 is selectively sensed by a frame mounted switch (not shown). To prevent damage to the frame mounted switch it is preferably mounted on a pneumatic cylinder so that it may be moved toward the die 22 to sense the target and then move away before operation of the ram 20 or rotation of the turret 24.

Figure 3:
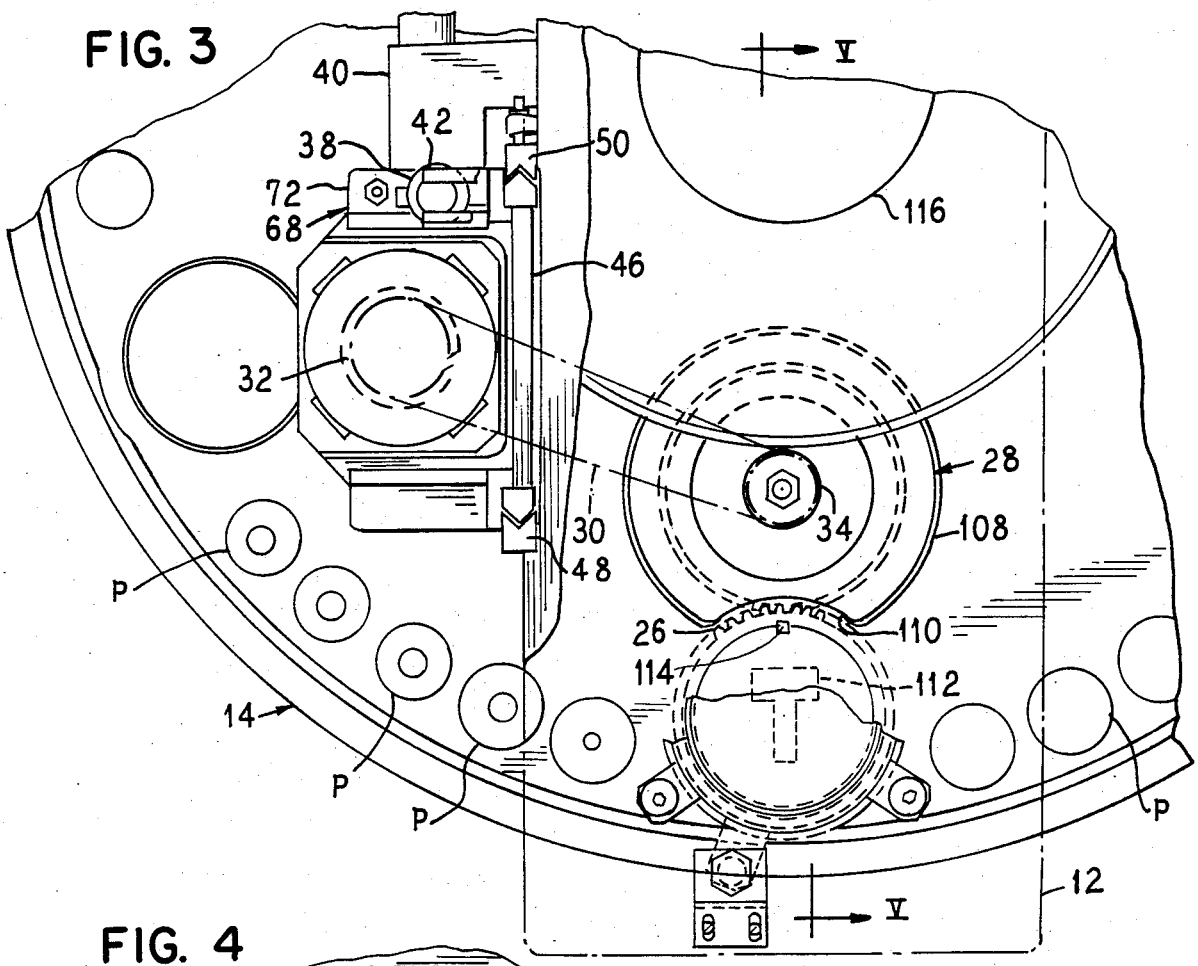
FIG. 3 is a plan view of the device shown in FIG. 2 generally at lines III—III.

FIG. 3 shows the upper turret 14 from above including a plurality of punches P. The slide plate 46 is mounted between the V-shaped slide rails 48 and 50. The pneumatic actuator 38 is seen suspended from the bracket 42 and the slide lock 40 and the arm 72 of the mechanical stop 68 can be seen more clearly. The timing belt 30 extends from the drive pulley 32 to the second pulley 34 under the housing 12. The harmonic gear drive 28 is enclosed by a housing 108 having a shaped opening 110 through which extends the geared bushing 26 of the indexable punch 16. The indexable punch 16 includes a T-shaped punch portion 112 for punching like shaped openings in sheet material M and is keyed to the geared bushing 26 by a key 114. The turret 14 is rotatable about a turret axis 116 to bring other punch tools P under the ram 20.

Figure 4:
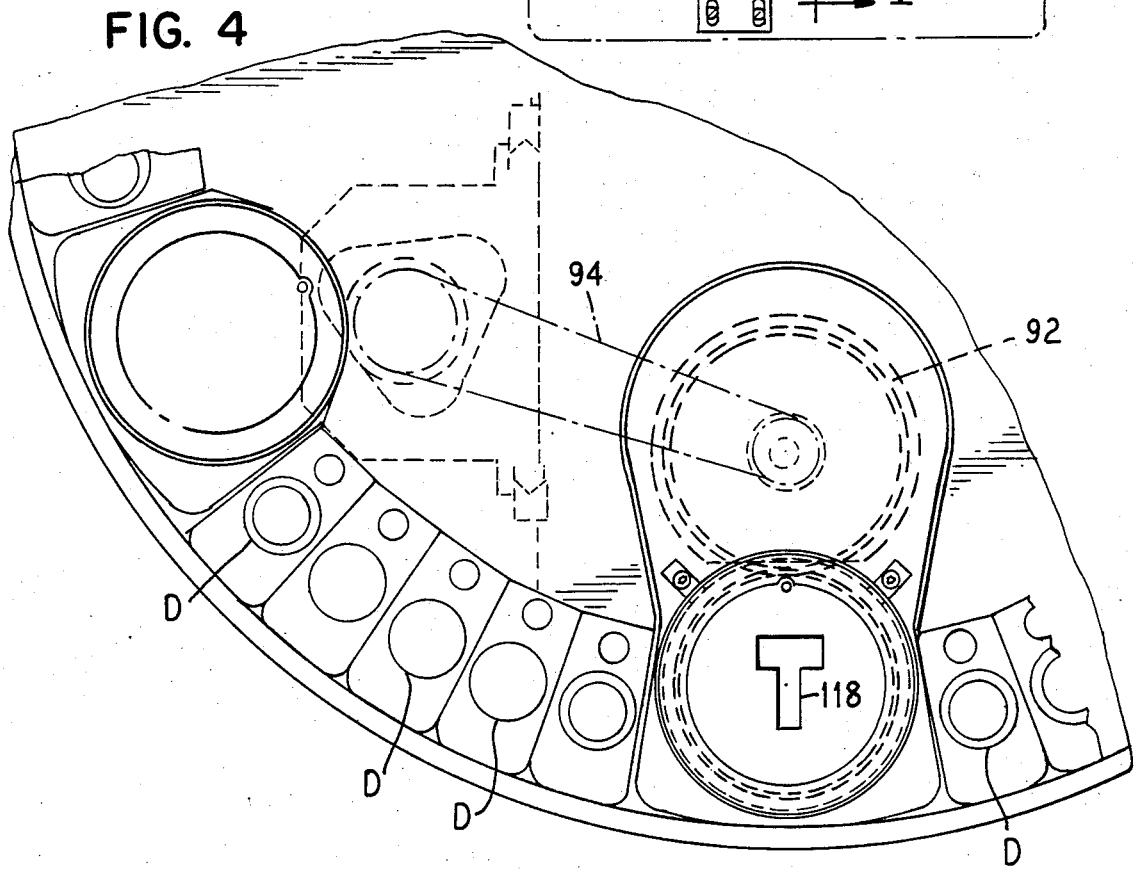
FIG. 4 is a plan view of the device shown in FIG. 2 along lines IV—IV.

FIG. 4 shows the lower turret 24 from above including the harmonic gear drive 92 and timing belt 94 in dotted outline. The indexable die 22 includes a T-shaped opening 118 for registration with the T-shaped punch portion 112 of the punch tool 16. Other die tool stations D are likewise shown at the periphery of the lower turret 24.

Figure 5:
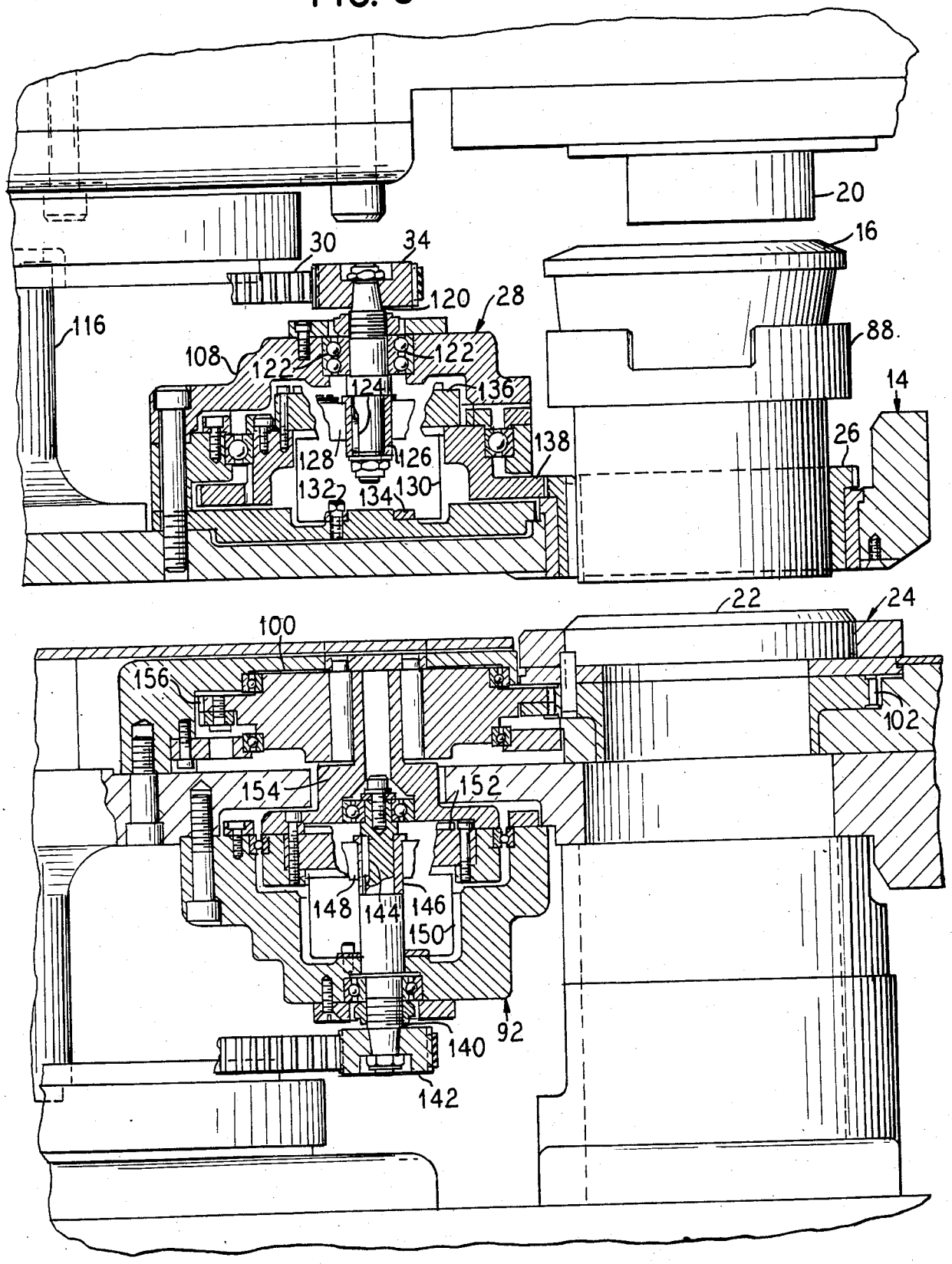
FIG. 5 is a cross-section of the device shown in FIGS. 3 and 4 along lines V—V.

FIG. 5 shows the harmonic gear drives 28 and 92 of the upper and lower turrets 14 and 24, respectively, in more detail. In the upper harmonic drive 28, the pulley 34 is secured to a shaft 120 extending through the harmonic drive housing 108 and mounted therein by bearings 122. A key 124 in the shaft 120 fixedly connects an oldham coupling 126 to a wave generator portion 128 of the harmonic drive 28. The wave generator portion 128 is spring loaded against a flex spline 130 which is clamped to the housing 108 by a bolt 132 extending through an anular ring 134. The flex spline 130 is geared to a circular spline 136 to which is bolted an output gear 138. The harmonic drive 28 provides a 61 to 1 gear reduction between the pulley 34 and the output gear 138 so that the rotational orientation of the output gear 138, and thus the punch 16, can be precisely determined while increasing the torque. The harmonic drive 28 can be repositioned somewhat to insure snug engagement of the output gear 138 with the geared bushing 26, thereby minimizing backlash.

The lower turret 24 includes the harmonic drive 92 which provides a similar gear reduction. The lower harmonic drive 92 includes a shaft 140 secured to a pulley 142 which is connected by a key 144 to an oldham coupling 146, which in turn is linked to a wave generator 148. The wave generator 148 is spring loaded to a flex spline 150 which in turn is geared to a circular spline 152. The circular spline 152 is bolted to a shaft 154 which connects it to the lower output gear 100. The lower output gear 100 drives the geared bushing 102 which rotates the indexable die 22.

For a lower drive, a gear set is spring loaded to take out backlash in a fixed center distance drive.

FIG. 6 shows a friction brake 158 for retaining the indexable punch 16 when motor 18 is not engaged. The friction break 158 includes a pivotally mounted arm 160 connected to the bearing housing 82 by a pivot pin 162. It is held against the timing belt 30 by a compression spring 164 encircling a rod 166 extending from the bearing housing 82. The compression spring 164 is held on the rod 166 by a washer 168 and lock nuts 170 threadably received on the rod 166. The arm 160 of the friction brake 158 is released from the belt 30 (as shown in dotted outline) by an adjustable abutting member 172 extending downward from the motor slide 36. The adjustable member 172 includes a bolt 174 and a lock nut 176 by which it may be adjusted.

FIG. 7 shows the arm 160 of the brake 158 and the shaped opening 58 which receives the tang and shaft assembly 56 of the helical coupling 52 when the motor slide 36 is moved to the engaged position.

The present device operates as follows:

Both the upper and lower turrets 14 and 24 are rotated until the indexable punch and die 16 and 22 are beneath the ram 20. The actuator 38 moves the motor slide 36 downward until the tang and shaft assembly 56 engages the shaped opening 58 in the drive pulley 34. The shot pin 60 locks the slide plate 46 in place by engaging the opening 64 in the bracket 62. The lowering of the motor slide 36 has released the brake 158 from the drive pulley 32 which enables the motor 18 to rotate the pulley 32. The timing belt 30 and harmonic drive 28 enable the motor 18 to rotate the punch 16 to a desired angular orientation as measured by the resolver 41. During this time, a lower motor and slide is coupling withe the lower drive pulley 142 and rotating the die 22 to an identical angular orientation is always maintained by servo. A piece of sheet material M is inserted between the punch and die 16 and 22 and the ram 20 forces the punch 16 through the material M and into the die 22, after which the stripper removes the punch 16 from the material M and the punched material is removed from the device 10.

The motors then operate to return the punch and die 16 and 22 to a predetermined home position, as established by the proximity sensors, the motor slide 36 is raised to a disengaged position and locked into place, and the turrets 14 and 24 are rotated to another punch tool position which may be either an indexable or a non-indexable position.

Thus there has been shown and described an indexable turret punch press having a reduced number of linkage steps between the motor and the indexable punch tool, providing an exact correspondence between motor rotation and punch tool rotation. A simpler and more reliable brake mechanism is provided to maintain a known punch tool orientation when the motor is disengaged.

It is apparent from the foregoing specification that the invention is susceptible to being embodied with various alterations and modifications which may differ particularly from those that I have described in the preceding specification and description. It should be understood that I wish to embody within the scope of the patent granted hereon all such modifications as reasonably and properly come within the scope of my contribution to the art.

I claim:

1. An indexable punch press apparatus having upper and lower turrets for selective rotation on a punch press housing and including a plurality of corresponding punch tools, comprising:

an indexable punch mounted for rotation in the upper turret, a first motor slidably mounted on said punch press housing and being selectively slidable between a first and second position, first linkage means for transmitting rotation of said first motor to said indexable punch when said first motor is in said second position, said first linkage means being disconnected to prevent the transmission of rotation by said first motor to said indexable punch when said first motor is in said second position, an indexable die mounted for rotation in said lower turret, a second motor slidably mounted on said punch press housing and being selectively slidable between a first and second position, second linkage means for transmitting rotation of said second motor to said indexable die when said second motor is in said second position, said second linkage means being disconnected to prevent the transmission of rotation by said second motor to said indexable die when said second motor is in said first position, and the upper and lower turrets being rotatable when said respective first and second motors are in said respective first positions.

2. An apparatus as claimed in claim 1, wherein said first linkage means includes a first harmonic gear drive and a first timing belt and first pulley pair mounted on the upper turret, and said second linkage means includes a second harmonic gear drive and a second timing belt and second pulley pair mounted on the lower turret.

3. An apparatus as claimed in claim 2, further comprising:

first coupling means for selectively linking said first motor to one of said first pulley pair, and second coupling means for selectively linking said second motor to one of said second pulley pair.

4. An apparatus as claimed in claim 2, further comprising:

a first geared bushing encircling said indexable punch and engaging said first harmonic gear drive, and a second geared bushing encircling said indexable die and engaging said second harmonic gear dirve.

5. An apparatus as claimed in claim 1, further comprising:

first and second brake means for selectively rendering said respective first and second linkage means immovable.

6. An apparatus as claimed in claim 1, further comprising:

first and second sensing means for detecting home positions of respective ones of said indexable punch and said indexable die.

7. An apparatus as claimed in claim 1, further comprising:

first and second actuators extending between the punch press housing and respective ones of said first and second motors and being operable to slide said first and second motors between said first and second positions respectively.

8. An indexable punch press apparatus having upper and lower turrets mounted for selective rotation on a punch press housing and including a plurality of corresponding punch tools, comprising:

an indexable punch mounted for rotation in the upper turret, a first motor slidably mounted on said punch press housing and being selectively slidable between a first and second position, first linkage means for transmitting rotation of said first motor to said indexable punch when said first motor is in said second position, an indexable die mounted for rotation in said lower turret, a second motor slidably mounted on said punch press housing and being selectively slidable between a first and second position, said second linkage means for transmitting rotation of said second motor to said indexable die when said second motor is in said second position, the upper and lower turrets being rotatable when said respective first and second motors are in said respective first positions, and first and second locking means for selectively locking said respective first and second motors in at least one of said first and second positions.

9. An indexable turret punch press for punching holes in sheet materials, comprising:

a punch press housing including a ram and an anvil disposed beneath said ram;

an upper turret rotatably mounted on said punch press housing between said ram and said anvil and including means for rotating said upper turret in a plane;

a lower turret rotatably mounted on said punch press housing between said ram and said anvil for rotation in a plane substantially parallel to and space from the plane of rotation of said upper turret, said lower turret including means for rotating said lower turret;

an indexable punch tool rotatably mounted in said upper turret and being selectively disposed between said ram and said anvil by rotation of said upper turret;

an indexable die roatatbly mounted in said lower turret and being selectively disposed between said ram and said anvil in registration with said punch tool by rotation of said lower turret;

a first motor movably mounted to said punch press housing for movement between first and second positions;

a first acutator mounted on said housing and operable to move said first motor between said first and second positions;

a first reduction drive on said upper turret having a high speed end and a low speed end, said low speed end connected to rotate said indexable punch tool;

a first coupling means rotationally coupling said first motor to said high speed end of said first reduction drive when said first motor is in said second position to rotate said indexable punch tool, said first coupling means disengaging said first motor from said high speed end when said first mtoor is in said first position;

a second motor movably mounted to said punch press housing for movement between first and second positions;

a second actuator mounted on said housing and operable to move said second motor between said first and second positions;

a second reduction drive on said lower turret having a high speed end and a low speed end, said low speed end connected to rotate said indexable die;

a second coupling means rotationally coupling said second motor to said high speed end of said second reduction drive when said second motor is in said second position to rotate said indexable die, said second coupling means disengaging said second motor from said high speed end when said second motor is in said first position; and control means for operating said upper and lower turrets and said first and second actuators and said first and second motors to position said indexable punch tool and said indexable die for punching sheet materials.

10. An indexable turret punch press as claimed in claim 9, wherein said first coupling means includes:

a first shaft connected for rotation by said first motor;

tangs extending from said first shaft;

a shaped opening in said high speed end of said first reduction drive for receiving said first shaft and said tangs when said first motor is in said second position; and said second coupling means includes:

a second shaft connected for rotation by said second motor;

tangs extending from said second shaft;

a shaped openings In said high speed end of said second reduction drive for receiving said second shaft and said tangs when said second mtoor is in said second position.

11. An indexable turret punch press as claimed in claim 9, further comprising:

a first slide plate connected to said first motor;

first rails slidably mounting said first slide plate to said punch press housing so that said first motor slidably moves between said first and second positions;

said first asctuator being connected between said housing and one of said first mptor and said first slide plate and operable to slide said first slide plate along said first rails;

a second slide plate connected to said second motor;

second rails slidably mounting said second slide plate to said punch press housing so that said second motor slidably moves between said first and second positoins; and said seocnd actuator being connected between said housing and one of said second motor and said second slide plate and operable to slide said second slide plate along said second rails.

12. An indexable turret punch press as claimed in claim 11, further comprising:

a first brake arm pivotally mounted on said upper turret adjacent said high speed end of said first reduction drive, said first brake arm including a friction face abutting said high speed end to impede movement of said first reduction drive;

first biasing means for biasing said first brake arm to hold said friction face against said high speed end;

a first release member extending from said first slide plate to abut said first brake arm and overcome said first biasing means when said first motor is in said second position for unimpeded movement of said first reduction drive;

a second brake arm pivotally mounted on said lower turret adjacent said high speed end of said second reduction drive, said second brake arm including a friction face abutting said high speed end to impede movement of said second reduction drive;

second biasing means for biasing said second brake arm to hold said friction face against said high speed end; and a second release member extending from said second slide plate to abut said second brake arm and overcome said second biasing means when said second mtoor is in said second position for unimpeded movement of said reduction drive.

13. An indexable turret punch press as claimed in claim 11, further comprising:

a first bracket mounted on said first slide plate and defining an opening;

a first slide lock mounted on said punch press housing and having a shot pin movable into said opening in said first bracket to lock said first slide plate in one of said first and second positions, said shot pin being movable to a position free of said opening so that said first slide plate can move along said first rails;

a second bracket mounted on said second slide plate and defining an opening; and a second slide lock mounted on said punch press housing and having a shot pin movable into said opening in said second bracket to lock said second slide plate in one of said first and second positions, said shot pin being movable to a position free of said opening so that said second slide plate can move along said second rails.

14. An indexable turret punch press as claimed in claim 9, wherein said first reduction drive includes:

a first drive pulley at said high speed end of said first reduction drive mounted on said upper turret for rotation by said first motor through said first coupling means;

a first harmonic drive assembly mounted at said upper turret and having an input and an output, said first harmonic drive assembly output connected to rotate said indexable punch tool;

a first driven pulley connected at said input of said first harmonic drive assembly;

a toothed belt connected between said first drive pulley and said first driven pulley for mutual rotation; and said second reduction drive includes:

a second drive pulley at said high speed end of said second reduction drive mounted on said lower turret for rotation by said second motor through said second coupling means;

a second harmonic drive assembly mounted at said lower turret and having an input and an output, said output of said second harmonic drive connected to rotate said indexable die;

a second drive pulley connected at said input of said second harmonic drive assembly;

a toothed belt connected between said second drive pulley and said second driven pulley for mutual rotation.

* * * * *

UNITED STATES PATENT AND TRADEMARK OFFICE
CERTIFICATE OF CORRECTION

PATENT NO. : 4,658,688

DATED : April 21, 1987

INVENTOR(S) : Harshad M. Shah et al

It is certified that error appears in the above—identified patent and that said Letters Patent is hereby corrected as shown below:

In column 5, line 48, "withe" should read --with--;
In column 7, line 59, "roatatbly" should read —rotatably—;
In column 8, line 47, "openings In" should read —opening in—;
In column 8, line 58, "asctuator" should read —actuator—;
In column 8, line 59, "mptor" should read —motor—;
In column 8, line 66, "positoins" should read —positions—;
In column 8, line 67, "seocond" should read —second—;
In column 9, line 28, "mtoor" should read --motor--.

Signed and Sealed this

Twenty-seventh Day of April, 1993

*Attest:*

MICHAEL K. KIRK

*Attesting Officer*

*Acting Commissioner of Patents and Trademarks*